United States Patent [19]

Gardner

[11] 4,249,691

[45] Feb. 10, 1981

[54] PARTITION STRUCTURE

[75] Inventor: Jeffrey M. Gardner, Wheaton, Ill.

[73] Assignee: Container Corporation of America, Chicago, Ill.

[21] Appl. No.: 131,440

[22] Filed: Mar. 18, 1980

[51] Int. Cl.[3] ..... B65D 5/48

[52] U.S. Cl. ..... 229/15; 229/42

[58] Field of Search ..... 229/15, 42

[56] References Cited

U.S. PATENT DOCUMENTS

| | | | |
|---|---|---|---|
| 2,899,122 | 8/1959 | Schaeffer | 229/42 X |
| 3,738,561 | 6/1973 | Nederveld | 229/15 |
| 4,030,659 | 6/1977 | Gardner | 229/15 X |
| 4,108,348 | 8/1978 | Partain | 229/15 |
| 4,136,815 | 1/1979 | Gardner | 229/15 |
| 4,148,428 | 4/1979 | Gardner | 229/15 |
| 4,155,501 | 5/1979 | Young | 229/15 |
| 4,171,745 | 10/1979 | Zicko | 229/15 |

*Primary Examiner*—Davis T. Moorhead

*Attorney, Agent, or Firm*—Richard W. Carpenter

[57] ABSTRACT

A partition structure is formed from a unitary blank of paperboard to provide a plurality of cells within a package or container.

5 Claims, 6 Drawing Figures

PARTITION STRUCTURE

SUMMARY OF THE INVENTION

The invention structures are particularly adapted for use with shipping containers and are formed from blanks of paperboard which can be cut and scored in such a fashion as to provide for six or nine cells or compartments within a container.

THE DRAWINGS

Figure 1:
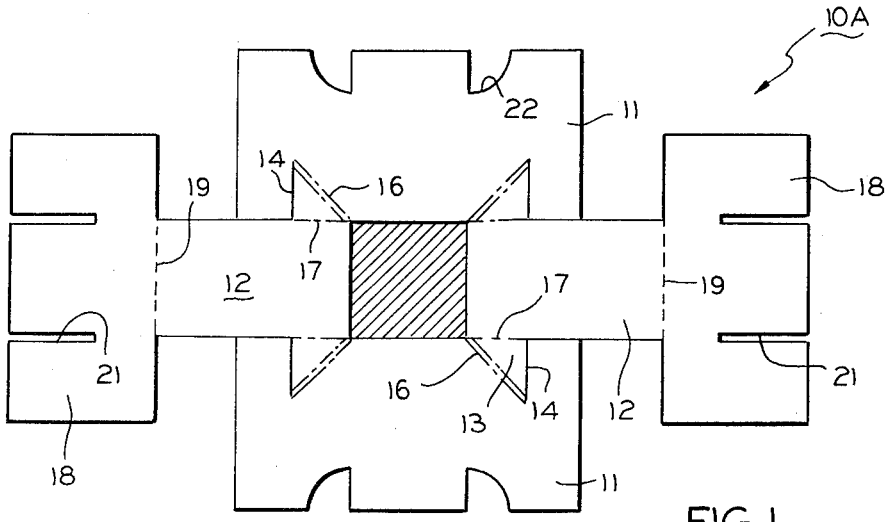
FIG. 1 is a plan view of a cut and scored blank for forming a partition structure according to one embodiment of the invention.
Figure 2:
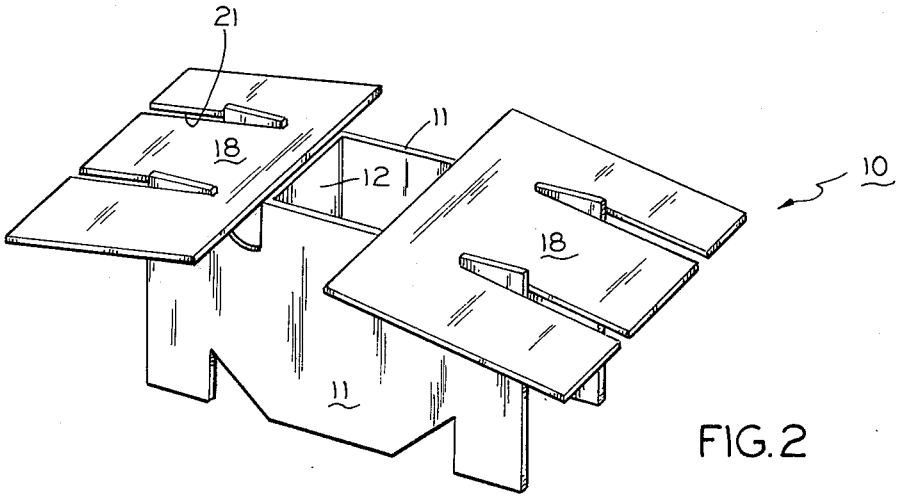
FIG. 2 is an isometric view showing a step in folding of the blank of FIG. 1.
Figure 3:
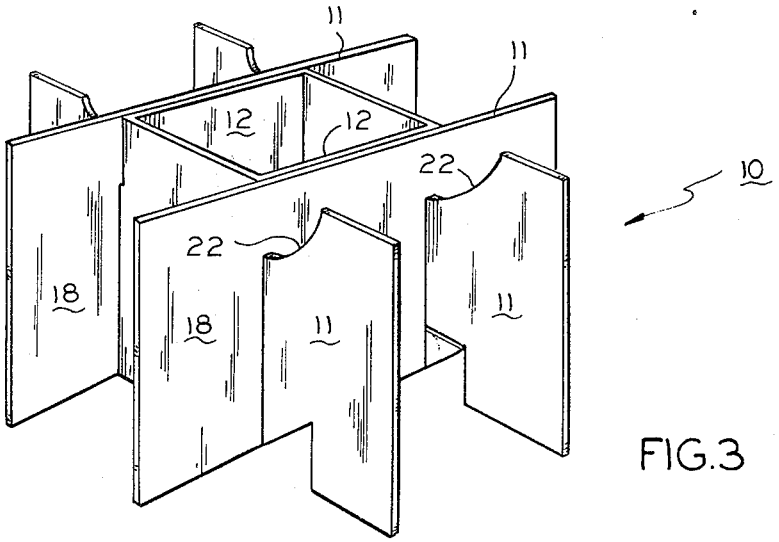
FIG. 3 is an isometric view showing the completed structure.

The partition structure according to one embodiment of the invention is seen in FIGS. 1 to 3 and is denoted by the reference numeral 10. It is formed from a cut and scored blank 10A and comprises a pair of longitudinal partition elements 11 joined to transverse partition elements 12 by gussets 13 each defined by a cut line 14, spaced diagonal score lines 16 and fold lines 17.

Transverse partitions 18 are joined to distal ends of transverse partition elements 12 along fold lines. When the elements 12 are erected with elements 11 along the fold lines 17, the transverse partitions 18 are folded, as seen in FIG. 2, along fold lines 19.

The transverse partitions 18 are provided with slots 21, so that the transverse partitions 18 intersect the transverse partitions 12. The transverse partitions 18 are folded into facing relationship with the transverse partition elements 12, and the folding step is aided by providing cutout portions 22 in the longitudinal partition elements 11.

The resulting structure 10 seen in FIG. 3 provides nine cells or compartments.

Figure 4:
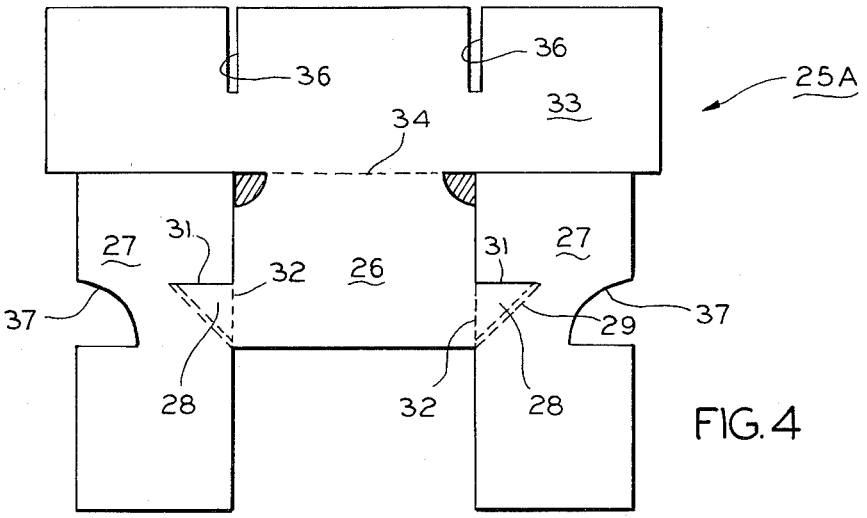
FIG. 4 is a plan view of a cut and scored blank for forming a partition structure according to another embodiment.
Figure 5:
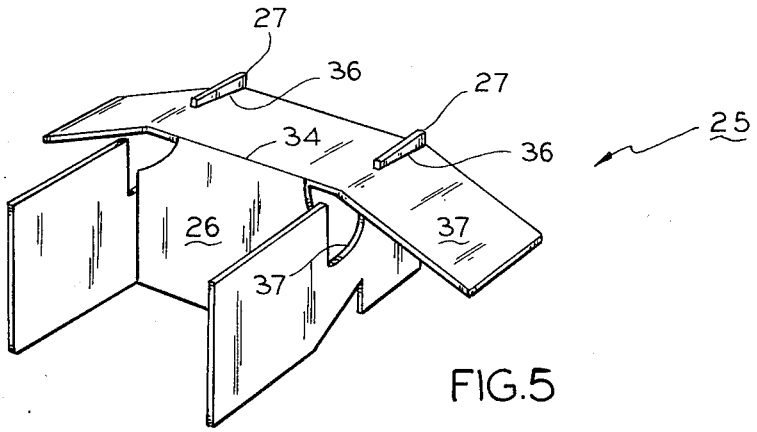
FIG. 5 is an isometric view showing a step in the folding of the blank of FIG. 4.
Figure 6:
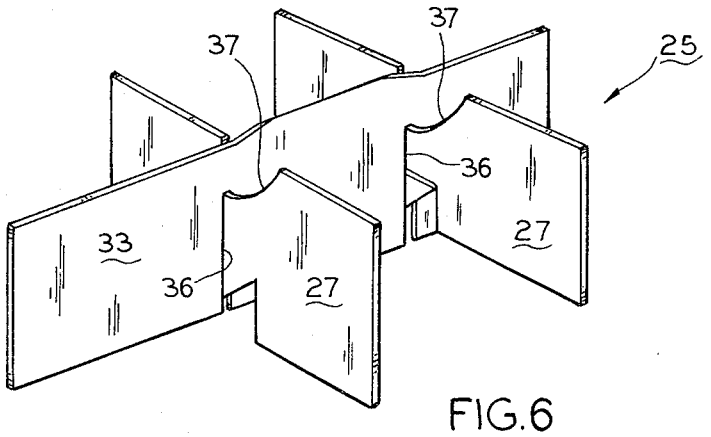
FIG. 6 is an isometric view showing the completed structure.

The second embodiment of the invention is shown in FIGS. 4 to 6, and is denoted by the reference numeral 25. It is formed from a cut and scored blank 25A and comprises a longitudinal partition element 26 having foldably joined thereto transverse partition elements 27. Elements 26 and 27 are joined by gussets 28 each defined by diagonal fold lines 29, a cut line 31 and a fold line 32.

When the transverse partition elements 27 are erected, longitudinal partition element 26 is likewise erected, and a locking panel 33, connected to transverse partition element 26 along a fold line 34, is folded, as seen in FIG. 5. The locking panel 33 is provided with slots 36 embracing the transverse elements 27 and is folded into facing relationship with the element 26. Folding of the panel 33 is facilitated by providing cutout portions 37 in the transverse elements 27.

The locking panel 33 is folded into a facing relationship with the longitudinal partition element 26 and together therewith forms the longitudinal partition of the structure seen in FIG. 6 to provide six cells or compartments.

I claim:

1. A partition structure formed from a unitary blank of paperboard for dividing an outer container into a plurality of cells, comprising:

(a) a vertical longitudinally extending partition element;

(b) transverse partition elements foldably connected to said longitudinally extending partition elements along a gusset formed between said longitudinal partition element and each of said transverse partition elements;

(c) a locking panel foldable with respect to said longitudinally extending partition element into locking engagement with said transverse partition elements and against said longitudinally extending partition to define a plurality of cells.

2. A partition structure according to claim 1, wherein said locking panel is formed with slots the edges of which embrace said transverse partition elements to enable said locking panel to move into facing relationship with said longitudinal partition element to define a longitudinal partition.

3. A partition structure according to claim 1, wherein said transverse partition elements are each provided with cut-out portions to provide for movement of the locking panel into facing relationship.

4. A partition structure formed from a unitary blank of paperboard for dividing an outer container into a plurality of cells, comprising:

(a) a pair of laterally spaced vertical longitudinally extending partition elements;

(b) each of said longitudinally extending elements being foldably connected to laterally spaced transverse partition elements along gussets formed between said longitudinal elements and said transverse elements;

(c) a transverse partition foldably connected to each transverse partition element and intersecting said longitudinal elements at slots formed in each transverse partition;

(d) said transverse partitions being foldable against said transverse partition elements.

5. A partition structure according to claim 4 wherein said longitudinal partition elements are provided with cutout portions to accommodate folding of said transverse partitions to position.

* * * * *